United States Patent [19]

Olufs

[11] Patent Number: 4,688,788

[45] Date of Patent: Aug. 25, 1987

[54] WEIGHT DEVICES AND METHOD FOR AEROBIC EXERCISE

[76] Inventor: Robert J. Olufs, 7550 - 14th Ave., Kenosha, Wis. 53140

[21] Appl. No.: 826,767

[22] Filed: Feb. 6, 1986

[51] Int. Cl.[4] ..... A63B 1/00; A63B 21/06

[52] U.S. Cl. ..... 272/70; 272/117; 272/124

[58] Field of Search ..... 272/70, 117, 93, DIG. 9, 272/124, 116; 135/66, 76; 280/809, 819; 273/77 A, 80 A, 81 A; 84/477 B

[56] References Cited

U.S. PATENT DOCUMENTS

| | | | |
|---|---|---|---|
| 3,820,781 | 6/1974 | Kane | 272/117 |
| 4,351,348 | 9/1982 | Axton | 272/DIG. 9 |
| 4,461,479 | 7/1984 | Mitchell | 273/77 A |

FOREIGN PATENT DOCUMENTS

| | | | |
|---|---|---|---|
| 2308394 | 8/1974 | Fed. Rep. of Germany | 280/819 |
| 2724208 | 11/1978 | Fed. Rep. of Germany | 280/809 |
| 630919 | 12/1961 | Italy | 280/819 |
| 98588 | 4/1940 | Sweden | 280/819 |

*Primary Examiner*—Richard J. Apley
*Assistant Examiner*—S. R. Crow
*Attorney, Agent, or Firm*—Peter N. Jansson, Ltd.

[57] ABSTRACT

A pair of weight devices and a method for using them for improved aerobic exercise during walking. The devices each include an elongated rigid member with a ground-engageable member at one end and a hand grip at the opposite end, a strap secured to the hand grip to form a loop adjacent thereto, and weighting to place the center of gravity of the device toward the hand-grip end. In preferred forms, the weight means is secured at or near the hand grip. The method of this invention involves walking with a pair of such elongated weight devices and applying alternating lifting and driving force to them. In preferred forms, each hand is engaged with the weight devices alternately in two different ways, by holding the hand grips and by applying downward force on the straps.

16 Claims, 7 Drawing Figures

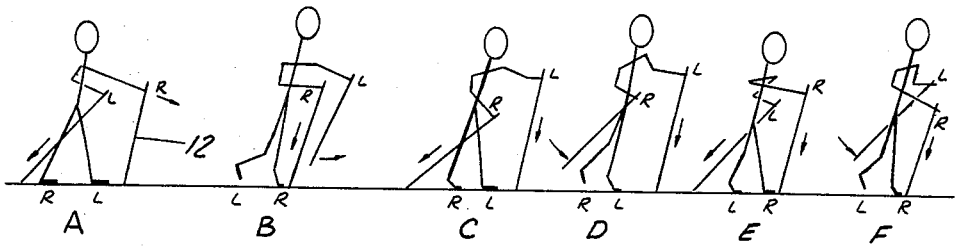
FIG. 6
| HAND POSITIONS IN FIG. 6 SEQUENCE (AS IN FIG. 4 OR FIG. 5) | | |
|---|---|---|
| FIG. 6 SEQ. | RIGHT HAND (R) | LEFT HAND (L) |
| A | 4 | 5 |
| B | 5 | 4 |
| C | 5 | 5 |
| D | 4 | 5 |
| E | 5 | 5 |
| F | 5 | 4 |
FIG. 7
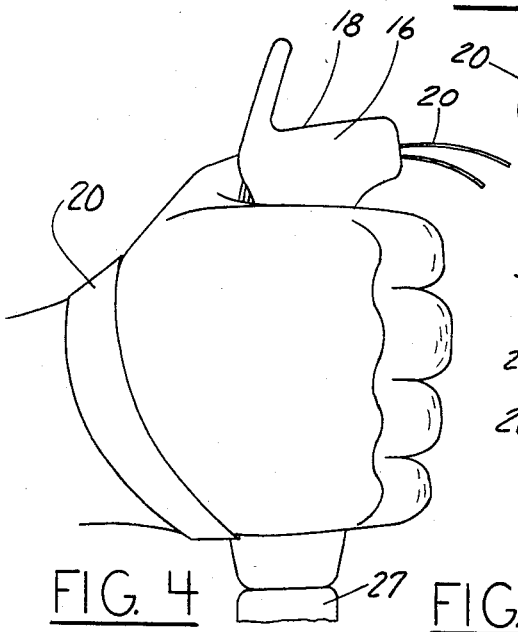
FIG. 4
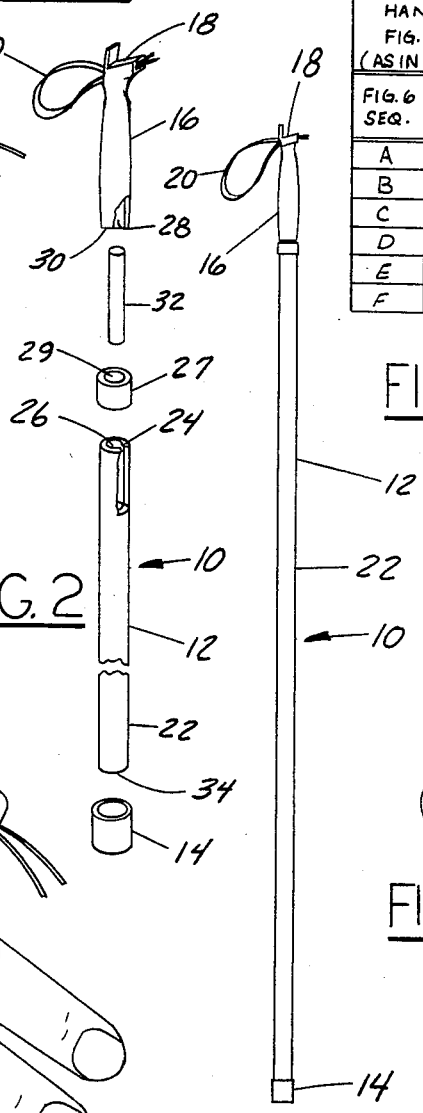
FIG. 2
FIG. 1
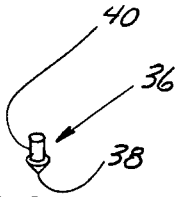
FIG. 3
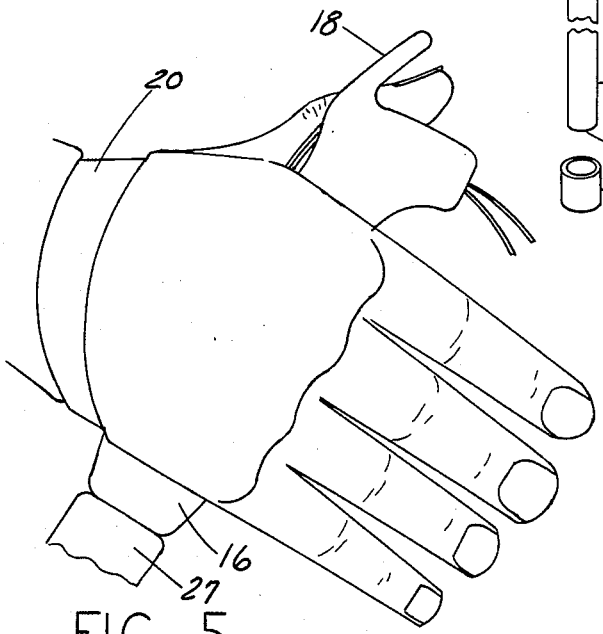
FIG. 5

WEIGHT DEVICES AND METHOD FOR AEROBIC EXERCISE

FIELD OF THE INVENTION

This invention is related generally to apparatus for use in aerobic exercise and, more particularly, to weight devices used to enhance the exercise benefits of walking.

BACKGROUND OF THE INVENTION

Walking has always been advocated as a beneficial health measure. But recently there has been a surge in participation and interest in so-called "exercise-walking," such that exercise-walking is following in the path of jogging and running as a growing popular physical-fitness activity.

Recent polls show that some 50 million Americans walk for exercise. One great advantage of walking is that it is an appropriate form of exercise for nearly everyone, regardless of age or cardio-vascular condition. Walking serves to strengthen the heart and lungs and to make them operate more efficiently. Walking also improves muscle and skeletal strength, particularly in the legs and lower body.

Walking involves, in one way or another, most of the 650 muscles and 206 bones in the human body. The rythmic arm swing of walking, which serves to help keep the body in balance, is to some extent helpful in toning the chest, shoulder and arm muscles. But the primary strenuous weight-moving exertion of walking is in the leg muscles.

A study by Mostardi, Gandee and Norris, published in the July 1981 *Archives of Physical Medicine and Rehabilitation* (pages 332–336), shows significant advantages of strenuous concurrent exercise of both the arms and the legs over strenuous exercise of the legs alone. The advantages of concurrent strenuous arm and leg exercise, over leg exercise alone, are not limited to the obvious benefits to the arm muscles and related skeletal areas.

The study indicated that, with concurrent strenuous exercise of arms and the legs, an equal improvement in maximal aerobic power was achieved with a lower heart rate and with considerably less stress on the heart. It was also found that when strenuous arm work is used in combination with strenuous leg work, there was better progress in reducing arterial blood pressure, increasing the level of conditioning, and improving the overall feeling of well-being.

In the prior art, the use of hand-held weights has been found to enhance the benefits of walking, both in improving the heart and lung functions and in improving muscle and skeletal strength. However, the hand-held weights of the prior art have problems and shortcomings which make them less than satisfactory in providing strenuous arm and upper-body exercise during walking.

More specifically, carrying the hand-held weights of the prior art tends to interfere with the most comfortable walking rhythms. For example, the hands or the weights themselves tend to bump into the thighs of the walker carrying them because they have no support during any portion of the walking-movement cycle other than through the arms and shoulders of the user.

Furthermore, carrying the hand-held weights of the prior art during walking does not require or even naturally encourage any lifting motion or manipulation such as would be helpful for providing strenuous exercise in the arms and upper body. Apart from a well-disciplined effort by a walker, exercise motions would involve strenuous exercise by only a limited number of the muscles in the area. And, then such strenuous exercise tyically will not continue very long apart from application of substantial will power.

Various other things which a walker has carried, such as a cane or a walking stick, are intended for guidance, support and/or style. An implement of that type plays and can play very little role in exercising or in any exercise plan.

In short, there is a need for devices and methods which can provide strenuous exercise of the muscles of the arm and upper body in a natural and convenient way during walking.

SUMMARY OF THE INVENTION

This invention is a pair of weight devices and a method for enhanced aerobic exercise during walking. The method and apparatus of this invention overcome some of the problems and deficiencies in the prior art, including those enumerated above.

The devices of this invention are elongated rigid weight devices each of which are intended to be grasped in one of the hands of the user. Each weight device includes an elongated rigid member having a ground-engageable member at one end and a hand grip member at the opposite end, and a strap means attached to the grip member to form a loop adjacent thereto. The device has a weight distribution such that its center of gravity is toward the end including the hand grip, preferably much closer to the hand-grip end than to the ground-engageable end.

The strap means is a flexible loop preferably secured to the distal end of the hand grip member and extending beside the hand grip such that the user's hand can be placed through the loop and hold the hand grip. In this form, the user's hand can engage the weight device in two ways, as hereafter more fully explained, either by holding the hand grip or by releasing the hand grip and, in effect, leaning on the strap.

In preferred embodiments, the rigid member has weight means, preferably in the form of an internal cylindrical weight, secured thereto near the distal end. This is a preferred way to place the center of gravity of the weight device of this invention at a position toward the hand-grip end. The weight means is most preferably secured to the grip member, and may have one end inserted into the grip member and its opposite end inserted into the end of an elongated middle member which forms most of the length of the weight device. In this form, the weight also functions as a means to connect the hand grip member with the remainder of the elongated rigid member.

The total weight of the elongated weight device of this invention can vary over a wide range, depending on the extent of exercise desired. However, the elongated devices of this invention are different than common walking sticks, which are intended to be light. It is preferred that the elongated weight devices of this invention have a total weight of at least 18 ounces. It is most preferred that the total weight be at least 24 ounces.

The elongated weight devices of this invention are of a length approximating the armpit height of the user to facilitate proper operation, as will hereafter be described. For adults, most of whom are between 5 and 6.5 feet in height, the elongated rigid member has a length on the order of 40–60 inches. A user normally will select a pair of elongated weight devices having a length about equal to his or her armpit height.

As noted, the center of gravity of the elongated weight device of this invention is preferably much closer to the distal end, that is, the end of the hand grip member, than it is to the opposite end, that is, the end having the ground-engageable member. In preferred embodiments, the center of gravity is at least 7 inches closer to the hand grip end than it is to the ground-engageable end. In the most preferred embodiments, it is at least 10 inches closer to the hand grip end.

The method of this invention involves engaging one of the elongated weight devices described above in each hand and manipulating them in a particular manner during walking. The user's hands are inserted through the strap loops to engage the devices.

The elongated weight devices engaged by the right and left hands are in different positions and orientations as walking proceeds. That is, while one is being lifted from a rearward position and carried to a forward position, the other is planted on the ground and force is being applied downwardly and rearwardly on it as the user walks past it. Of course, these motions alternate for each of the user's hands and for each of the two elongated weight devices. These alternating motions allow strenuous exercise of different sets of arm and upper-body muscles as the user walks along.

To a greater or lesser extent, the walker using the elongated weight devices of this invention will use the downward and rearward application of force to propel himself in a forward direction.

In the most preferred form of the method of this invention, the hands of a user are engaged with the elongated weight devices in two different ways. When an elongated weight device is being lifted and carried through the air, the hand is inserted through the loop and grasps the hand grip. When the elongated weight device is planted on the ground and downward force is being applied to it, the user's hand is released from the hand grip and downward pressure is applied through the strap loop which is attached to the grip member. This allows considerable freedom of movement and reduces the possibility of chafing and blistering during extended aerobic exercise.

In its most preferred form the method of this invention involves a number of steps in alternating repetitive sequence. While a first hand is released from holding the hand grip of a first elongated weight device and is pushing such elongated device from a forward position to a rearward position by applying downward and rearward force through the strap loop, the second hand is gripping the hand grip of the second elongated weight device to: (1) lift it to remove its ground-engageable member from the ground; (2) carry it forward to a forward position; and (3) plant the ground-engageable member of such second elongated weight device on the ground.

Thereafter, the hand grip of the second elongated weight device is released to allow subsequent application of force through the strap to push the second elongated weight device from a forward to a rearward position as outlined above with respect to the first hand. As such application of force begins, the first hand, which by then has moved the first elongated weight device to a rearward position beside and behind the walker, will shift from applying downward and rearward force on the strap to holding the hand grip of the first device. This enables the user to lift the first device. Thus, the roles of the two hands are reversed.

The users of this invention may swing the two elongated weight devices in different rhythmic patterns. Some will prefer to swing them every two steps and others will prefer to swing them every four steps or in some other pattern. The user will have his own reasons for the specific way in which he uses the method of this invention.

Unlike hand-held weights of the prior art which are utilized during walking, the elongated weight devices of this invention naturally encourage continued strenuous exercise of the arm and upper-body muscles during walking. And, unlike devices of the prior art, the elongated weight devices of this invention are easily used and are not prone to bump the user's thighs or other parts of his body.

OBJECTS OF THE INVENTION

It is an object of this invention to provide an improved method and apparatus for aerobic exercise overcoming some of the problems and shortcomings of certain methods and apparatus of the prior art.

Another object of this invention is to provide improved means for arms and upper-body exercise during walking.

Another object of this invention is to provide improved weight devices for arm and upper-body exercise during walking which overcomes problems with hand-held weights of the prior art.

Another object of the invention is to probide weight devices for arm and upper-body exercise during walking which may be easily and comfortably used.

Another object of this invention is to provide weight devices for arm and upper-body exercise during walking which are easily and naturally manipulated in strenuous exercise over extended periods.

Still another object of this invention is to provide a method and apparatus for improving aerobic powers with reduced heart rate and stress.

Another object of this invention is to provide improved apparatus allowing easy and convenient strenuous exercise of arm muscles, concurrent with exercise of the leg muscles by walking.

These and other objects will be apparent from the following additional descriptions and from the drawings, wherein:

BRIEF DESCRIPTION OF THE DRAWINGS

FIG. 1 is a side elevation of the weight device of this invention.

FIG. 2 is a fragmentary exploded perspective view.

FIG. 3 is a perspective view of an alternate form of ground-engaging tip.

FIGS. 4 and 5 are representations of the two hand positions (holding methods) preferably used with this invention.

FIG. 6 is a series of sequential schematic representations ilustrating the method of this invention, and is to be read and understood with reference to FIGS. 4, 5 and 7.

FIG. 7 is a chart indicating the hand positions preferably used in the sequence of user positions illustrated in FIG. 6.

DETAILED DESCRIPTION OF PREFERRED EMBODIMENTS

The figures illustrate an aerobic weight device 10 which is a preferred embodiment of this invention. Aerobic weight device 10 includes an elongated rigid member 12 which has a ground-engageable member 14 at its lower end and a hand grip member 16 at its upper end. A strap loop 20 is attached to the distal end 18 of hand grip member 16.

As illustrated best in FIG. 2, elongated rigid member 12 includes an elongated middle member 22 to which hand grip 16 and ground-engageable member 14 are attached. Middle member 22, which is preferably tubular, has a grip-adjacent end 24 which has an opening 26 to a hollow core. Hand grip 16 is also hollow and has an opening 28 at its proximal end 30. Openings 26 and 28 are dimensioned to receive a single cylindrical weight 32. Middle member 22 has an internal ledge (not shown) or other means to limit the extent of insertion of weight 32 into opening 26. The dimensions of cylindrical weight 32 and openings 26 and 28 provide a fairly tight engagement of weight 32 with hand grip member 16 and middle member 22.

A cap member 27 having an upper opening 29 is slipped over grip-adjacent end 24 of middle member 22. Upper opening 29 of cap member 27 allows cylindrical weight 32 to extend out of middle member 22 for insertion into hand grip member 16. Cap member 27 serves to cover any sharp upper edge of middle member 22 and to improve the appearance of the product.

Weight 32 serves to place the center of gravity of aerobic weight device 10 at an off-center position much closer to the hand grip end of elongated rigid member 12 than to the end having ground-engageable member 14. Cylindrical weight 32 also serves, by its insertion into openings 26 and 28, to interconnect grip member 16 and middle member 22, as previously described.

The diameter of cylindrical weight 32 effects its total weight. A greater diameter, of course, increases its weight. It is preferred that cylindrical weight 32 be made of lead, steel, or some other heavy metal. The weight need not be cylindrical in shape. Any shape which can be accommodated with the other needs of the structure would be acceptable. Indeed, the weight can be integrally-formed with grip member 16 or with middle member 22. The weight and the weight distribution requirements of this invention may be met in a number of ways.

It is highly preferred that middle member 22 be made of a strong, rigid, and relatively light-weight material, such as fiberglass, aluminum or other light-weight metals, or rigid polymeric materials. Various composite materials may be used as well. A wise variety of materials are suitable for middle member 22. And, middle member 22 is preferably, but not necessarily, a hollow tube along its full length, as previously mentioned.

Using a relatively light-weight middle member 22 and a relatively heavy cylindrical weight 32 is highly preferred because it is desirable that aerobic weight device 10 have a center of gravity fairly close to hand grip member 16. It is also desirable that weight device 10 have substantial total weight. Cylindrical weight 32 preferably extends into hand grip 16 along substantially its full length, and may extend as far into middle member 22 as is necessary to provide sufficient weight. Of course, for each additional incremental extension of cylindrical weight 32 into middle member 22 there is a decreasing effect in movement of the center of gravity toward grip member 16.

The total weight of weight device 10 is preferably at least 18 ounces and most preferably at least 24 ounces. Higher weights of course, allow more strenuous lifting exercise during portions of the walking movement. However, the downward-driving movement provides another exercise motion which is not dependent upon the weight of weight device 10.

Elongated rigid member 12 preferably has a length equal to the arm pit height of the user. For adults, the appropriate height normally falls within the range of about 40–60 inches. The center of gravity along elongated rigid member 12 is preferably at least 7 and most preferably at least 10 inches closer to the hand grip end of rigid member 12 than it is to the opposite end. Indeed, using a relatively heavy cylindrical weight 32 and a relatively light-weight material for middle member 22, the center of gravity can easily be positioned at a location spaced from distal end 18 by as little as one-third or even one-quarter of the total length of rigid member 12.

Ground-engageable member 14, as illustrated in FIGS. 1 and 2, is preferably slipped over the lower end 34 of middle member 22. However, interconnection of middle member 22 and ground-engageable member 14 can be accomplished in a variety of ways. Ground-engageable member 14 is preferably a rubber or rubber-like material which will not slide when it engages the ground.

FIG. 3 illustrates an alternative ground-engageable member 36. Ground-engageable member 36 is a hard metallic piece having a sharpened end 38 for biting into ice or other walking surfaces. Ground-engageable member 36 has an upper portion 40 of reduced diameter which is inserted into the hollow lower end 34 of metal member 22.

In operation, a pair of aerobic weight devices 10 are engaged by a walker, one in each hand. The use inserts his hand through strap loops 20 and holds hand grips 16 in the manner illustrated in FIG. 4. Straps 20 help the user to retain control weight device 10 during walking.

In a preferred method of operation, the user's hands will engage weight device 10 in two different ways—the manner illustrated in FIG. 4 and the manner illustrated in FIG. 5. Such hand positions will alternate depending upon the position and direction of motion of weight device 10 at different parts of the walking cycle.

In the hand position of FIG. 4, the thumb and fingers hold hand grip 16 such that weight device 10 can be lifted off the ground. In the hand position of FIG. 5, the fingers and thumb are released from holding hand grip 16 and downward pressure is applied by the hand on strap 20. In this preferred manner, downward and rearward force is applied to weight device 10 through strap 20. Such loose engagement of a user's hand with elongated weight device 10 allows him to easily and comfortably propel himself in a forward direction.

FIGS. 6 and 7, which refer to the hand positions shown in FIGS. 4 and 5, illustrate a preferred method of arm and upper body exercise during walking using a pair of aerobic weight devices 10. FIG. 6 illustrates a sequence of positions A–F.

In position A, the person's left hand is engaging a left elongated weight device in the manner illustrated in FIG. 5, and downward and rearward force had been applied through the strap loop to propel him forwardly. His right hand has gripped a right elongated weight device and moved it to a forward position where it has just been planted with its ground-engageable member on the ground.

In position B, the right hand has switched to the position shown in FIG. 5 and the user is beginning to apply downward and rearward force through the right elongated weight device to propel himself in a forward direction. At the same time, the user has gripped the left elongated weight device in the manner illustrated in FIG. 4, has lifted the left weight device such that its ground-engageable member is off the ground, and is carrying the left weight device forward for subsequent re-engagement with the ground.

In position C, the user's right hand is still holding the right weight device in the manner illustrated in FIG. 5 and the right weight device is near its rearward position. The user's left hand has placed the left weight device on the ground and he has just changed his left hand engagement with the left weight device from the position shown in FIG. 4 to the position shown in FIG. 5.

In position D, the user's right hand is holding the hand grip of the right weight device in the manner shown in FIG. 4. He has just lifted the right weight device from the ground and is beginning to carry it in a forward direction with respect to his body position. His left hand, which is engaging the left weight device in the manner shown in FIG. 5, is beginning to apply downward and rearward force.

In position E, the user's left hand is still engaged in the position shown in FIG. 5 and the left weight device has reached the rearward position. The user has planted the right weight device and his right hand has released his hold on the grip member and taken the hand position shown in FIG. 5.

FIG. F merely illustrates the continuation of this alternating process.

The roles of the two hands are reversed in rhythmic fashion. The pair of height devices can be used to propel the walker in a forward direction, adding enjoyment and an additional form of strenuous exercise during walking. Users of the aerobic weight devices of this invention develop their own personal rhythms and walking styles. It is found, however, that use of a pair of elongated weight devices encourages strenuous arm and upper-body exercise in a manner not known in the prior art.

While the principles of this invention have been described in connection with specific embodiments, it should be understood clearly that these descriptions are made only by way of example and are not intended to limit the scope of the invention.

What is claimed:

1. A pair of hand-held devices for use in aerobic walking/lifting exercises, each comprising:

an elongated rigid member having a ground-engageable member at one end and a hand grip member at the opposite end, said grip member terminating in a distal end;

strap means secured to the grip member to form a loop adjacent thereto;

said rigid member having a length sufficient to extend at least from the ground to the user's armpit;

a weight secured to the rigid member near the grip member distal end; and said device weighing at least 18 ounces and having its center of gravity toward the hand-grip end, whereby strenuous aerobic exercise of different sets of arm and upper-body muscles is achieved during walking by substantial alternating upward lifting and downward thrusting exertions of such muscle sets, on both sides of the body.

2. The device of claim 1 wherein the weight means is secured to the grip member.

3. The device of claim 2 wherein the grip member is hollow and the weight means is received therein.

4. The device of claim 3 wherein the rigid member includes an elongated middle member having a grip-adjacent end which is hollowed to receive the weight means, and the weight means serves to connect the grip member to the middle member.

5. The device of claim 1 having a total weight of at least 24 ounces.

6. The device of claim 1 wherein the strap means is secured at the distal end and forms a loop extending along the length of the hand grip.

7. The device of claim 1 wherein the elongated rigid member has a length of about 40–60 inches.

8. The device of claim 7 wherein the center of gravity is at least 7 inches closer to the hand-grip end than it is to the ground-engageable end.

9. The device of claim 8 wherein the center of gravity is at least 10 inches closer to the hand-grip end than it is to the ground-engageable end.

10. The device of claim 8 wherein the weight means is secured to the grip member.

11. The device of claim 10 wherein the grip member is hollow and the weight means is received therein.

12. The device of claim 11 wherein the rigid member includes an elongated middle member having a grip-adjacent end which is hollowed to receive the weight means, and the weight means serves to connect the grip member to the middle member.

13. The device of claim 12 having a total weight of at least 24 ounces.

14. The device of claim 12 wherein the strap means is secured at the distal end and forms a loop extending along the length of the hand grip.

15. A method of exercise during walking, using first and second elongated devices each having an elongated rigid member with a ground-engageable member at one end and a hand grip member at the opposite end terminating in a distal end, a strap loop secured to the grip member near the distant end and extending along the hand grip, a weight secured to the right member near the grip member distal end to provide a center of gravity toward the hand-grip end and a total weight of at least 18 ounces, with first and second hands inserted through the loop of the first and second elongated weight devices, respectively, comprising the following steps in repetitive sequence:

while said first hand is holding said first device near said distal end and is pushing said first device from a forward position to a rearward position by applying downward and rearward force thereto:

gripping with said second hand the hand grip of said second device when it is in a rearward position;

lifting said second device to remove its ground-engageable member from the ground;

carrying said second device forward to a forward position;

planting the ground-engageable member of said second device on the ground to prepare for subsequent pushing of said second device from forward to rearward positions as outlined for said first hand and first device above; and switching the roles of said hands, whereby strenuous alternately and repetitive muscle motions occur during walking.

16. A method of exercise during walking, using first and second elongated devices each having an elongated rigid member with a ground-engageable member at one end and a hand grip member at the opposite end terminating in a distal end, a strap loop secured to the grip member near the distal end and extending along the hand grip, a weight secured to the rigid member near the grip member distal end to provide a center of gravity toward the hand-grip end and a total weight of at least 18 ounces, with first and second hands inserted through the loop of the first and second elongated weight devices, respectively, comprising the following steps in repetitive sequence:

while said first hand is released from holding the hand grip of said first device and is pushing said first device from a forward position to a rearward position by applying downward and rearward force thereto through the strap of said first device:

gripping with said second hand the hand grip of said second device when it is in a rearward position;

lifting said second device to remove its ground-engageable member from the ground;

carrying said second device forward to a forward position;

planting the ground-engageable member of said second device on the ground; and releasing the hand grip of said second device to allow subsequent application of force through the strap to push said second device from forward to rearward positions as outlined for said first hand and first device above; and switching the roles of said hands, whereby strenuous alternately and repetitive muscle motions occur during walking.

* * * * *

UNITED STATES PATENT OFFICE
CERTIFICATE OF CORRECTION

Patent No. 4,688,788 Dated August 25, 1987

Inventor(s) Robert J. Olufs

It is certified that error appears in the above-identified patent and that said Letters Patent are hereby corrected as shown below:

In column 8, line 45, the word "distant" should be --distal--.

Signed and Sealed this

Ninth Day of February, 1988

*Attest:*

DONALD J. QUIGG

*Attesting Officer*

*Commissioner of Patents and Trademarks*